US010243283B2

(12) United States Patent
Nagano

(10) Patent No.: US 10,243,283 B2
(45) Date of Patent: Mar. 26, 2019

(54) TERMINAL TEMPORARY HOLDING STRUCTURE

(71) Applicant: Yazaki Corporation, Tokyo (JP)

(72) Inventor: Masayuki Nagano, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/037,317

(22) Filed: Jul. 17, 2018

(65) Prior Publication Data

US 2019/0067841 A1 Feb. 28, 2019

(30) Foreign Application Priority Data

Aug. 30, 2017 (JP) ..... 2017-165365

(51) Int. Cl.
*H01R 12/00* (2006.01)
*H01R 9/24* (2006.01)
(Continued)

(52) U.S. Cl.
CPC ..... *H01R 9/2458* (2013.01); *H01R 9/223* (2013.01); *H01R 13/42* (2013.01); *H01R 13/642* (2013.01);
(Continued)

(58) Field of Classification Search
CPC .... H01R 9/226; H01R 9/2425; H01R 12/716; H05K 5/0026
(Continued)

(56) References Cited

U.S. PATENT DOCUMENTS 6,053,780 A * 4/2000 Ono ..... H01R 4/34 439/810
7,611,360 B2 * 11/2009 Akahori ..... H01R 4/185 439/76.2
(Continued)

FOREIGN PATENT DOCUMENTS

JP 6-310198 A 11/1994
JP 10-223272 A 8/1998
(Continued)

OTHER PUBLICATIONS

Communication dated Nov. 28, 2018 issued by the Great Britain Patent Office in counterpart Great Britain Application No. GB 1809775.8.

*Primary Examiner* — Hien D Vu
(74) *Attorney, Agent, or Firm* — Sughrue Mion, PLLC

(57) ABSTRACT

In a terminal temporary holding structure, a terminal fitting includes a cable connecting part, an electrical contact part fastened to the busbar terminal, and a connecting part connecting the electrical contact part and the cable connecting part. A terminal step part is formed in the terminal fitting at a position at which the connecting part and the electrical contact part are connected to each other. A housing in this structure includes a drop-in recess accommodating the electrical contact part and a suppressing part disposed over the cable connecting part and/or the cable. An engagement step part configured to engage to the terminal step part is formed in a step of a periphery of the drop-in recess so as to temporarily hold the terminal fitting in cooperation with the suppressing part before the electrical contact part is fastened to the busbar terminal by the fastening member.

4 Claims, 13 Drawing Sheets

(51) Int. Cl.

| | |
|---|---|
| ***H01R 9/22*** | (2006.01) |
| ***H01R 13/642*** | (2006.01) |
| ***H01R 13/42*** | (2006.01) |
| *H01R 4/34* | (2006.01) |
| *H01R 11/12* | (2006.01) |
| *H01R 25/16* | (2006.01) |

(52) U.S. Cl.
CPC ..... *H01R 4/34* (2013.01); *H01R 11/12* (2013.01); *H01R 25/162* (2013.01); *H01R 2201/26* (2013.01)

(58) Field of Classification Search
USPC ..... 439/76.2, 76.1, 535
See application file for complete search history.

(56) References Cited

U.S. PATENT DOCUMENTS

| | | | | |
|---|---|---|---|---|
| 9,583,848 | B2 * | 2/2017 | Shiraki | H01R 9/18 |
| 9,912,091 | B1 * | 3/2018 | Miyazawa | H01R 11/12 |
| 2016/0294075 | A1 | 10/2016 | Shiraki | |

FOREIGN PATENT DOCUMENTS

| | | | |
|---|---|---|---|
| JP | 2000-340273 | A | 12/2000 |
| JP | 2016-174504 | A | 9/2016 |

* cited by examiner

TERMINAL TEMPORARY HOLDING STRUCTURE

CROSS REFERENCE TO RELATED APPLICATIONS

This application is based on Japanese Patent Application (No. 2017-165365) filed on Aug. 30, 2017, the contents of which are incorporated herein by way of reference.

BACKGROUND

The present invention relates to a terminal temporary holding structure for temporarily holding a terminal fitting before fastening with a fastening member.

In order to perform electrical connection by fastening a terminal fitting for a cable terminal to a busbar terminal using a bolt, an example of using a terminal guiding part has been known (see Patent Document 1, for example).

[Patent Document 1] JP-A-2006-174504

SUMMARY

A terminal temporary holding structure according to the invention is characterized by the following (1) to (4).

(1) A terminal temporary holding structure including:

a busbar block including an insulating housing and a conductive busbar terminal;

a conductive terminal fitting inserted into the housing and electrically connected to the busbar terminal; and a cable in which a terminal thereof is connected with the terminal fitting, wherein the terminal fitting includes:

a cable connecting part connected to the cable;

an electrical contact part configured to be fastened to the busbar terminal by a fastening member and having a flat plate shape which is wider than the cable connecting part; and a connecting part that connects the electrical contact part and the cable connecting part, a terminal step part is formed in the terminal fitting at a position at which the connecting part and the electrical contact part are connected to each other, the housing includes a suppressing part and a drop-in recess, the drop-in recess accommodates the electrical contact part so that the electrical contact part is dropped along a fastening axis of the fastening member, the suppressing part is provided so as to be disposed over at least one of the cable connecting part and the cable in a state that the drop-in recess accommodates the electrical contact part, and an engagement step part configured to engage to the terminal step part is formed in a step of a periphery of the drop-in recess so as to temporarily hold the terminal fitting in cooperation with the suppressing part before the electrical contact part is fastened to the busbar terminal by the fastening member.

(2) The terminal temporary holding structure according to (1), wherein the drop-in recess includes a bottom surface receiving the electrical contact part and a busbar mounting part exposing the busbar terminal from the bottom surface in the state that the drop-in recess accommodates the electrical contact part.

(3) The terminal temporary holding structure according to (1) or (2), wherein the step of the drop-in recess restrict movements of the terminal fitting in a terminal inserting direction and a terminal width direction in the state that the drop-in recess accommodates the electrical contact part.

(4) The terminal temporary holding structure according to any one of (1) to (3), wherein a guided part is provided in the terminal fitting, and a guiding part is provided in the housing so as to come in contact with the guided part to guide the terminal fitting into the drop-in recess.

BRIEF DESCRIPTION OF DRAWINGS

FIGS. 9A and 9B are enlarged views of main parts, wherein FIG. 9A is an enlarged view of a portion indicated by an arrow C of FIG. 7 and FIG. 9B is an enlarged view of a portion indicated by an arrow D of FIG. 8.

DETAILED DESCRIPTION OF EXEMPLIFIED EMBODIMENTS

In the related art described above, there is concern that the terminal fitting for the cable terminal before the terminal fitting is fastened with the bolt comes off from the terminal guiding part provided as a housing for the terminal. This concern is thought to be likely to occur, for example, when a worker releases a hand holding the cable.

The present invention has been made in consideration of the above circumstances, and an object thereof is to provide a terminal temporary holding structure capable of preventing a terminal fitting for a cable terminal from coming off from a housing before fastening.

A terminal temporary holding structure includes a busbar block including a housing and a busbar terminal, a terminal fitting that is inserted into the housing and is connected to the busbar terminal, a cable to a terminal of which the terminal fitting is connected, a fastening member configured to fasten the terminal fitting inserted into the housing and the busbar terminal, and a temporary holding unit formed of a plurality of portions to temporarily hold the terminal fitting before fastening using the fastening member. The temporary holding unit includes terminal step parts and a guided part that are formed in the terminal fitting. The temporary holding unit includes a suppressing part, a drop-in recess, engagement step parts, and a guiding part that are formed in the housing. The drop-in recess is formed as a portion into which the terminal fitting is dropped by one step. The engagement step parts are a part of the drop-in recess, and are formed as portions with which the terminal step parts are engagable. The guiding part is formed as a portion for guiding the guided part when the terminal fitting is dropped into the drop-in recess.

Figure 1:
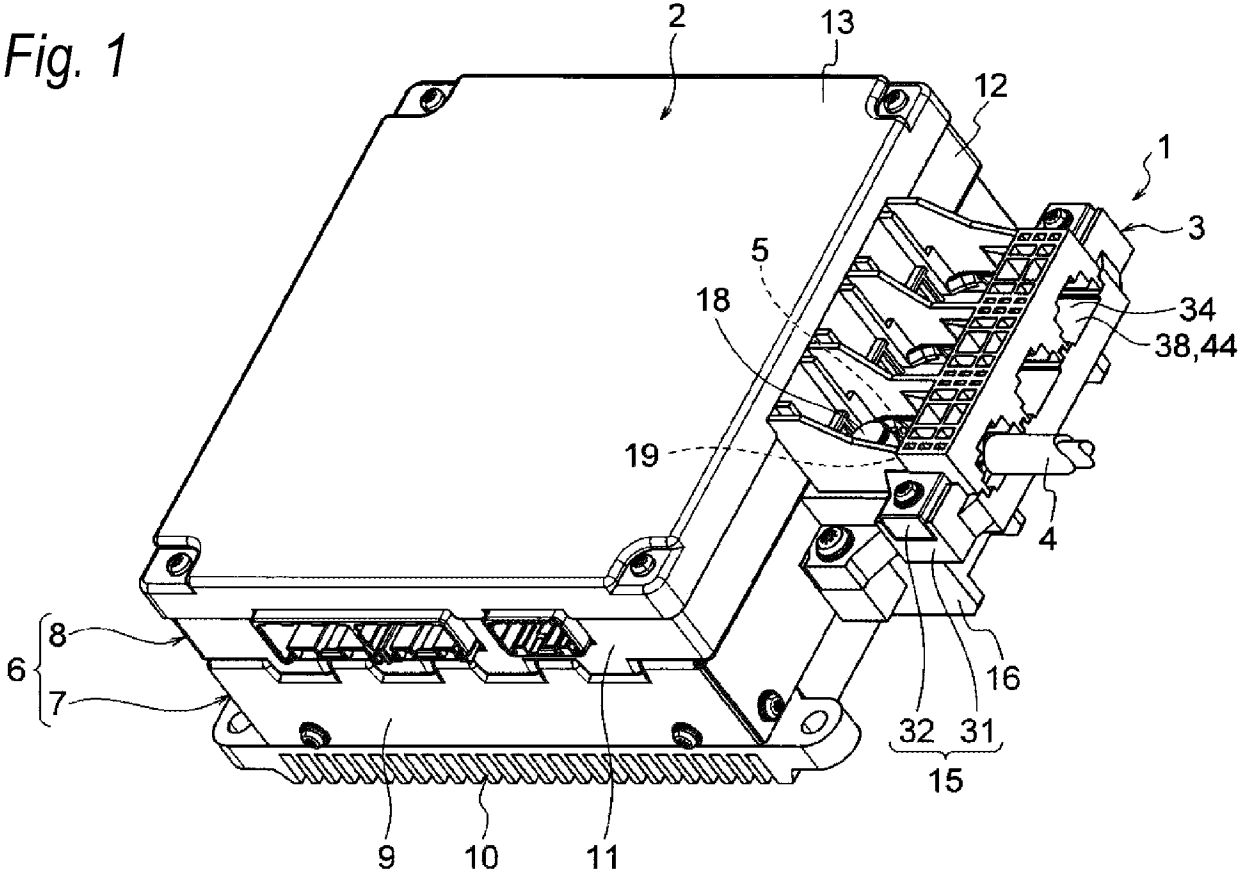
FIG. 1 is a perspective view of a device including a terminal temporary holding structure that is an embodiment of the present invention.
Figure 2:
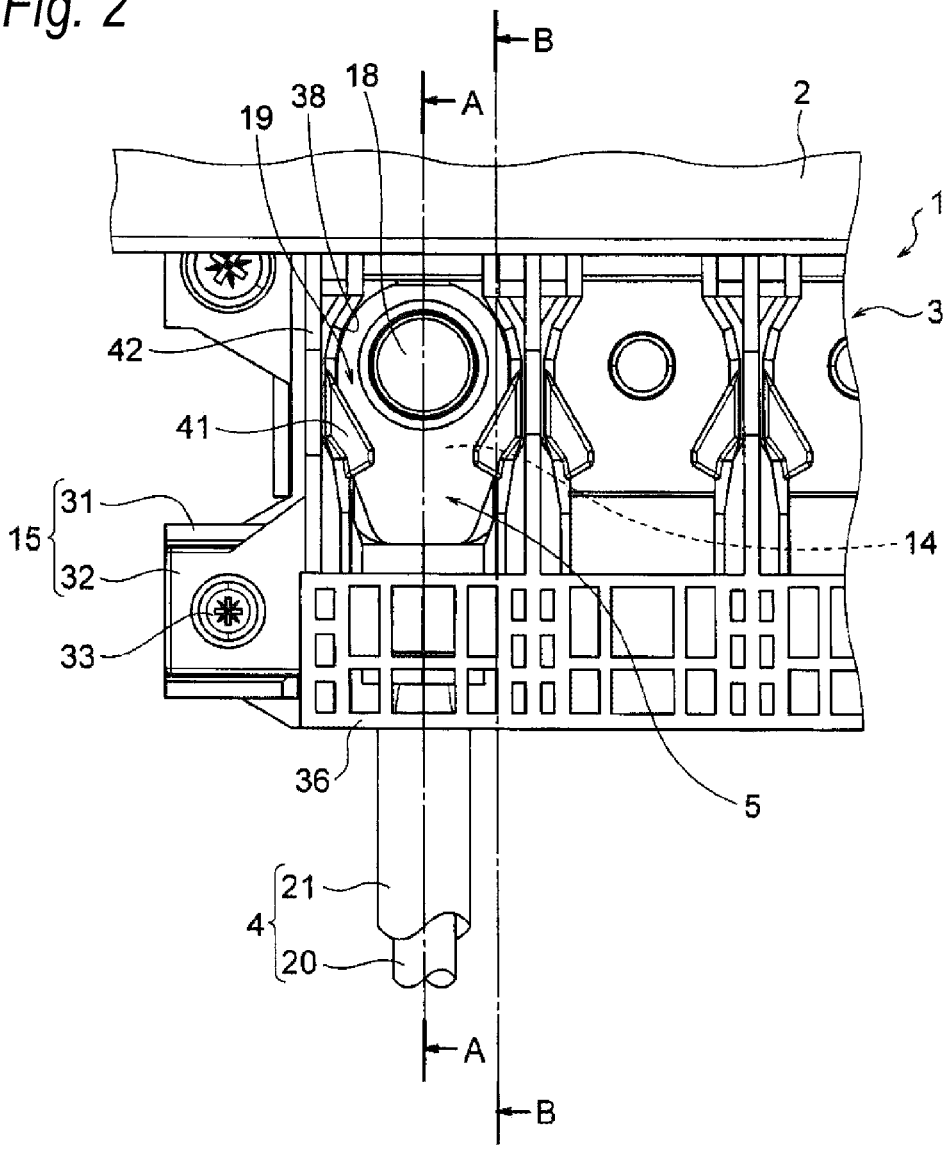
FIG. 2 is a plan view of the terminal temporary holding structure.
Figure 3:
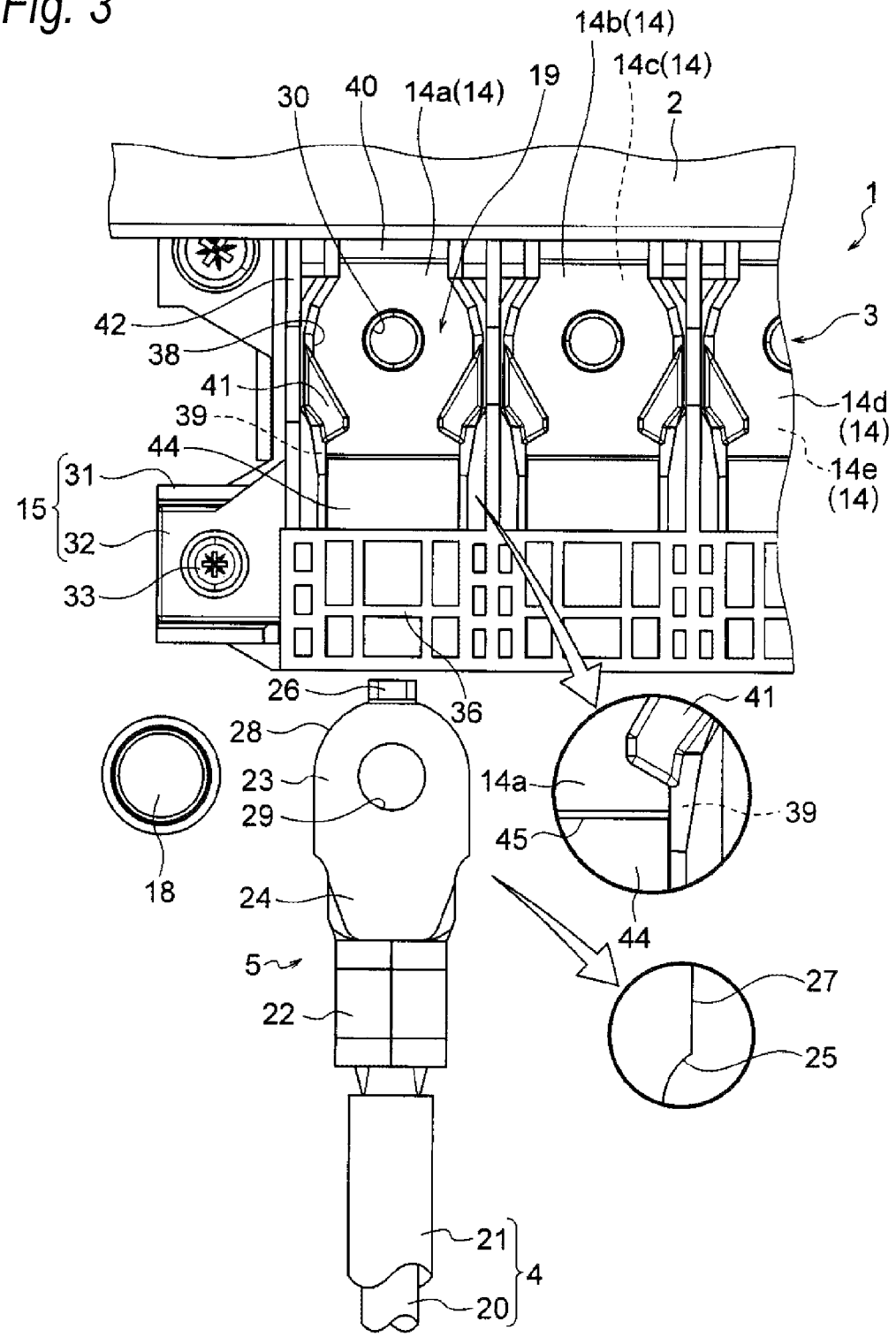
FIG. 3 is a plan view of the terminal temporary holding structure before a terminal fitting is inserted.
Figure 4:
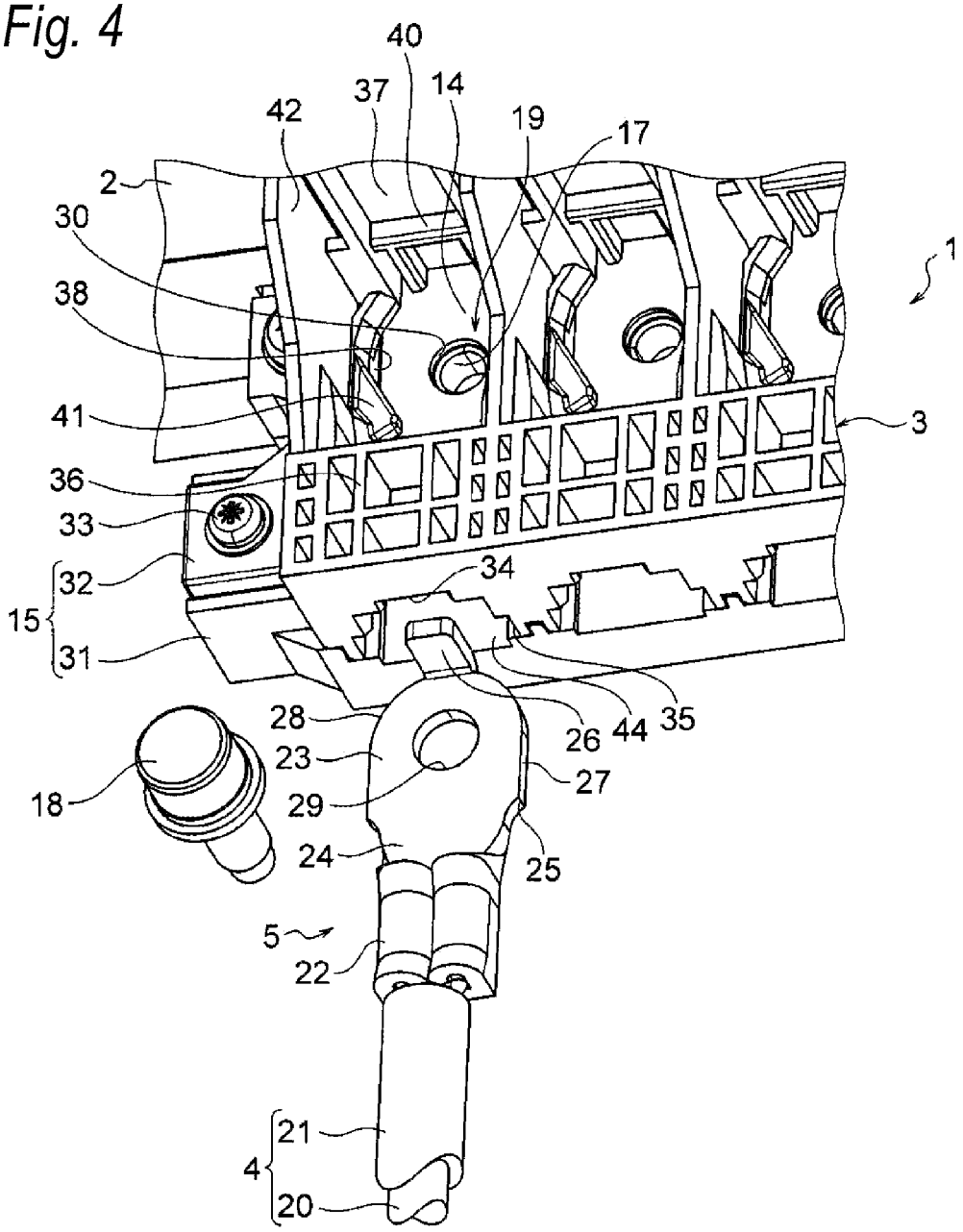
FIG. 4 is a perspective view corresponding to FIG. 3.
Figure 5:
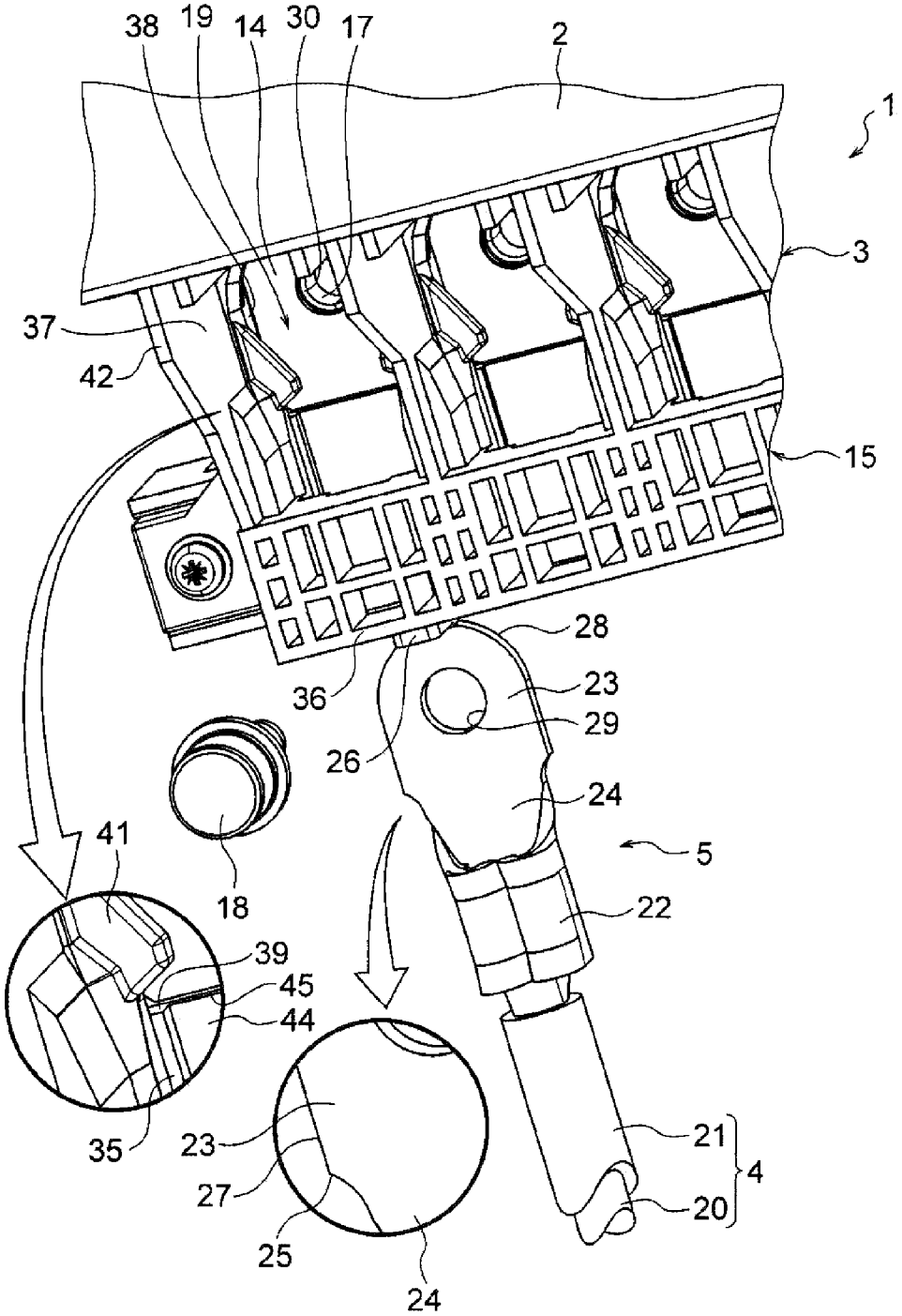
FIG. 5 is a perspective view corresponding to FIG. 4 as viewed from a different direction.
Figure 6:
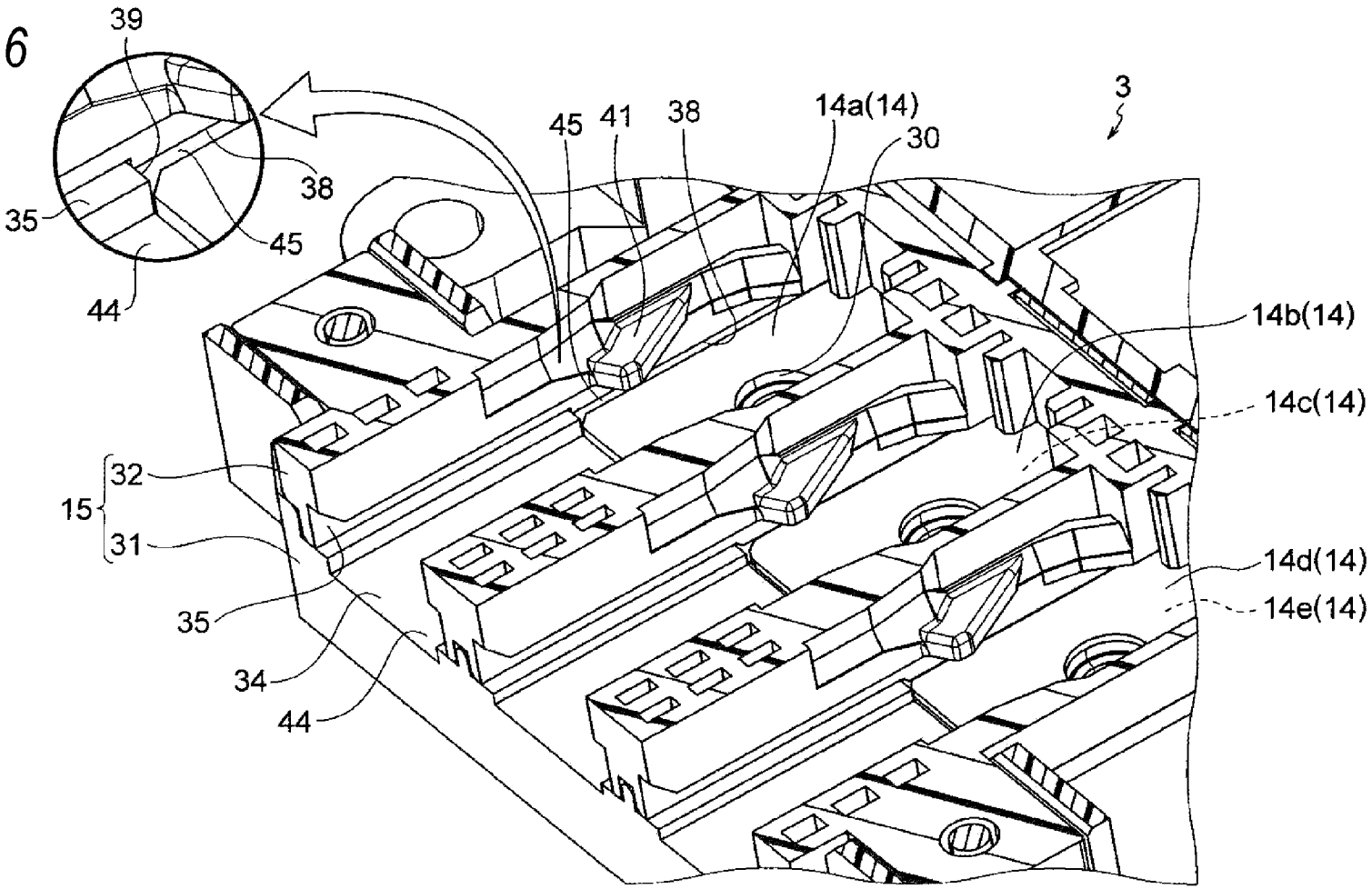
FIG. 6 is a perspective view (including a sectional view) of a temporary holding unit on a side of a housing.
Figure 7:
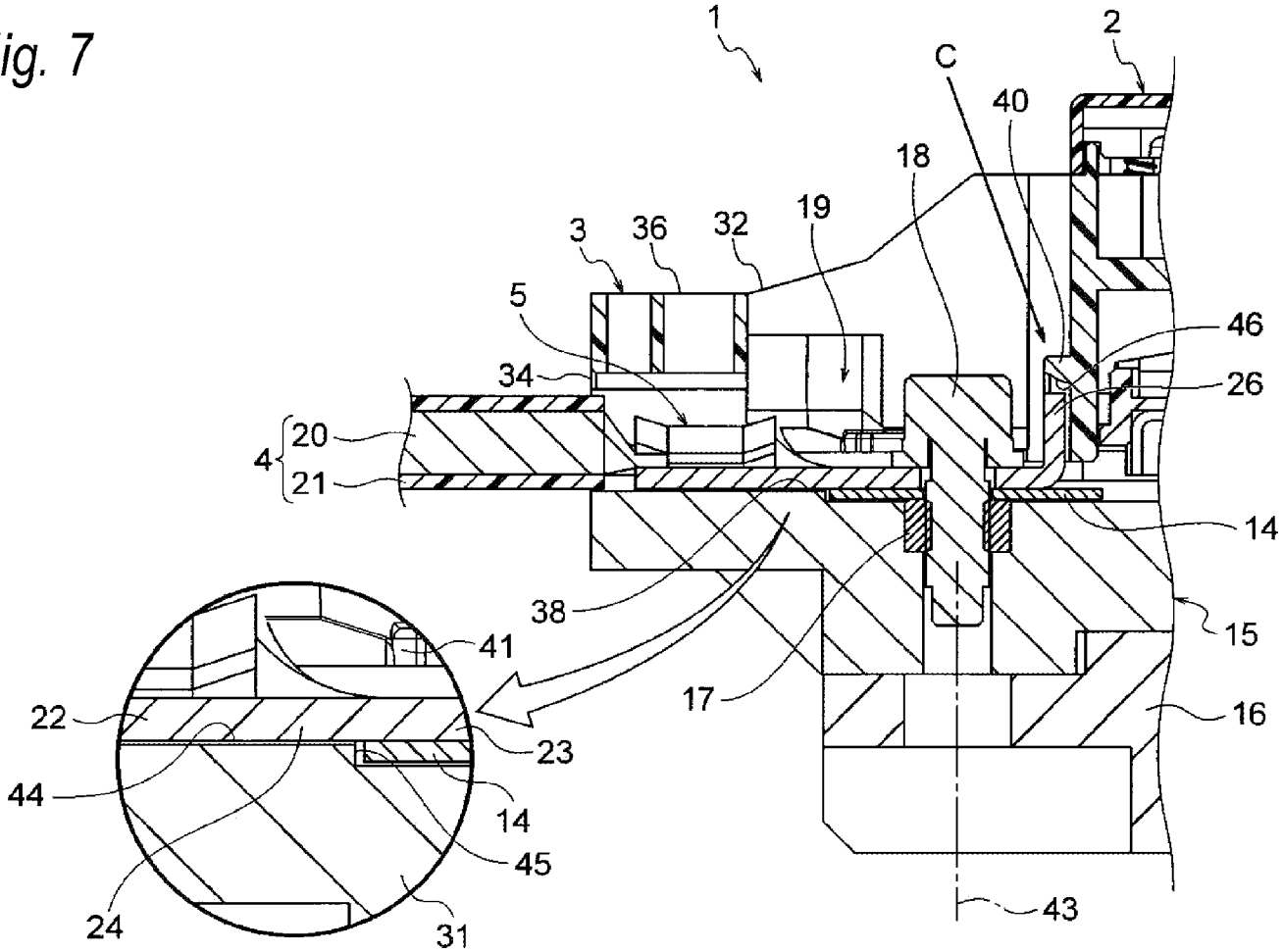
FIG. 7 is a sectional view taken along line A-A of FIG. 2.
Figure 8:
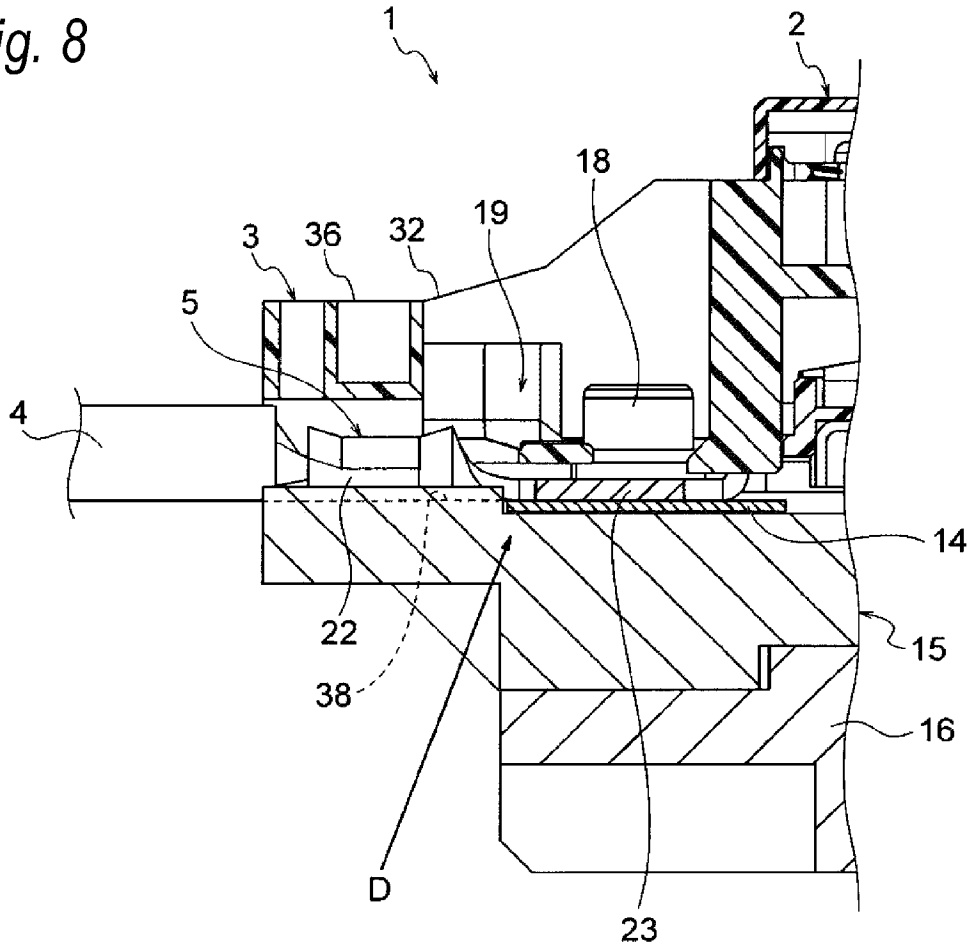
FIG. 8 is a sectional view taken along line B-B of FIG. 2.
Figure 9B:
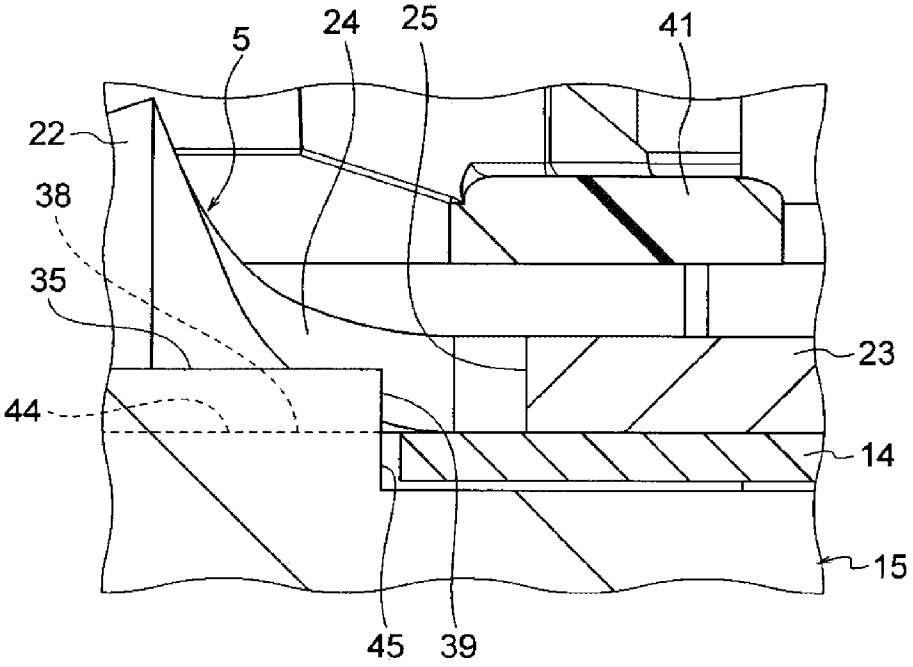
Figure 9A:
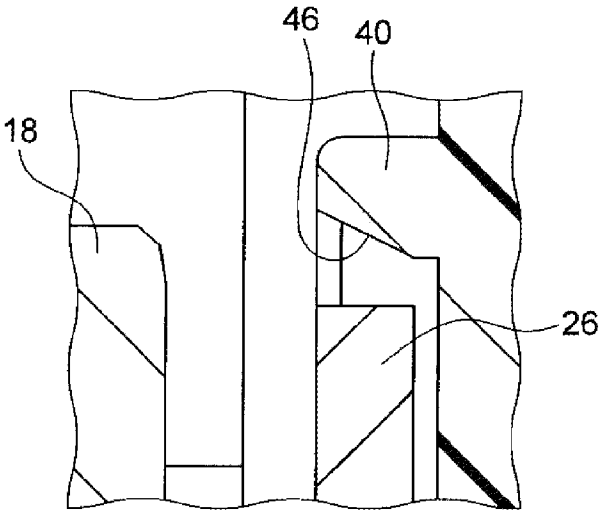
Figure 10:
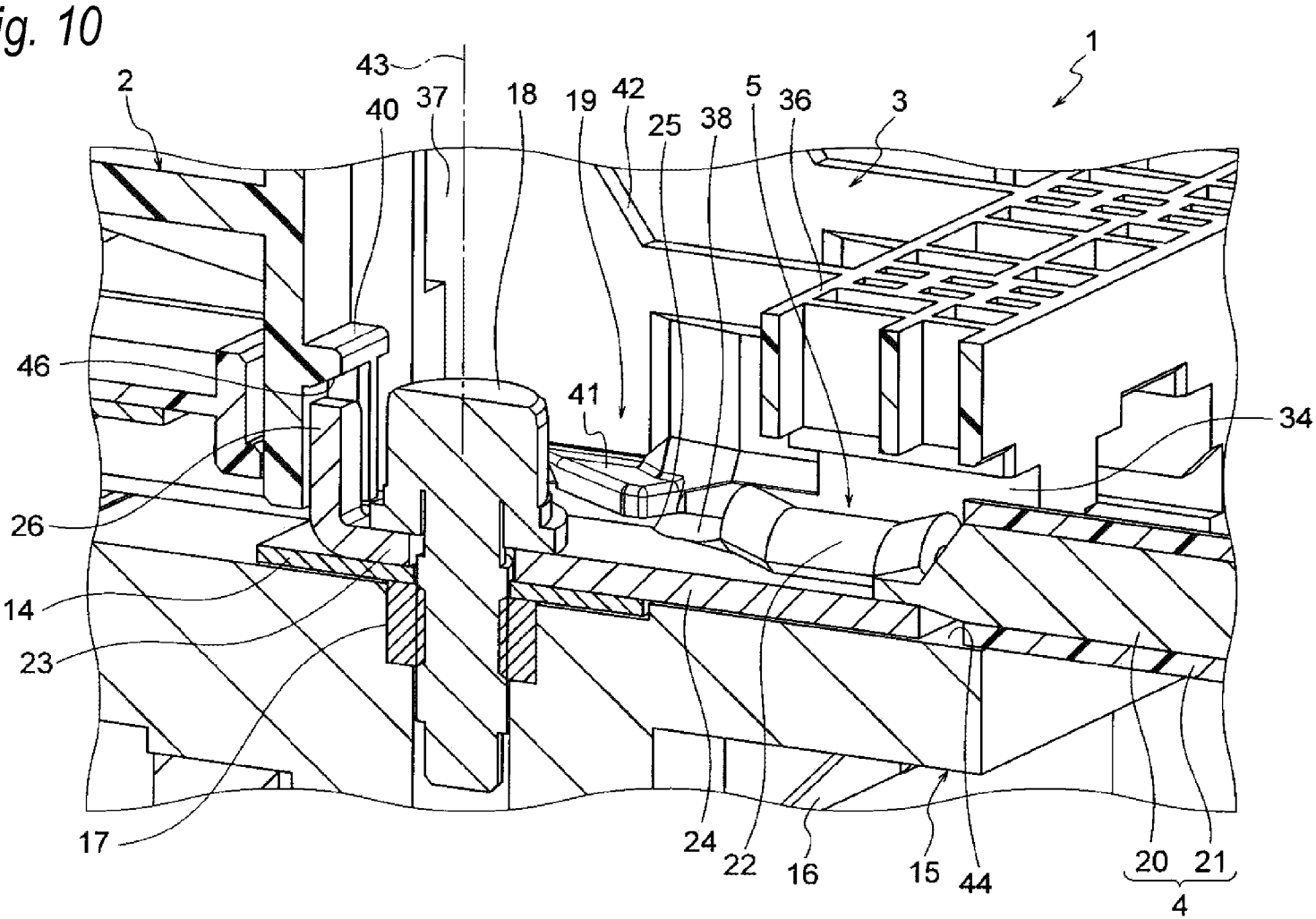
FIG. 10 is a perspective view (including a sectional view) corresponding to FIG. 7 as viewed from a different direction.
Figure 11:
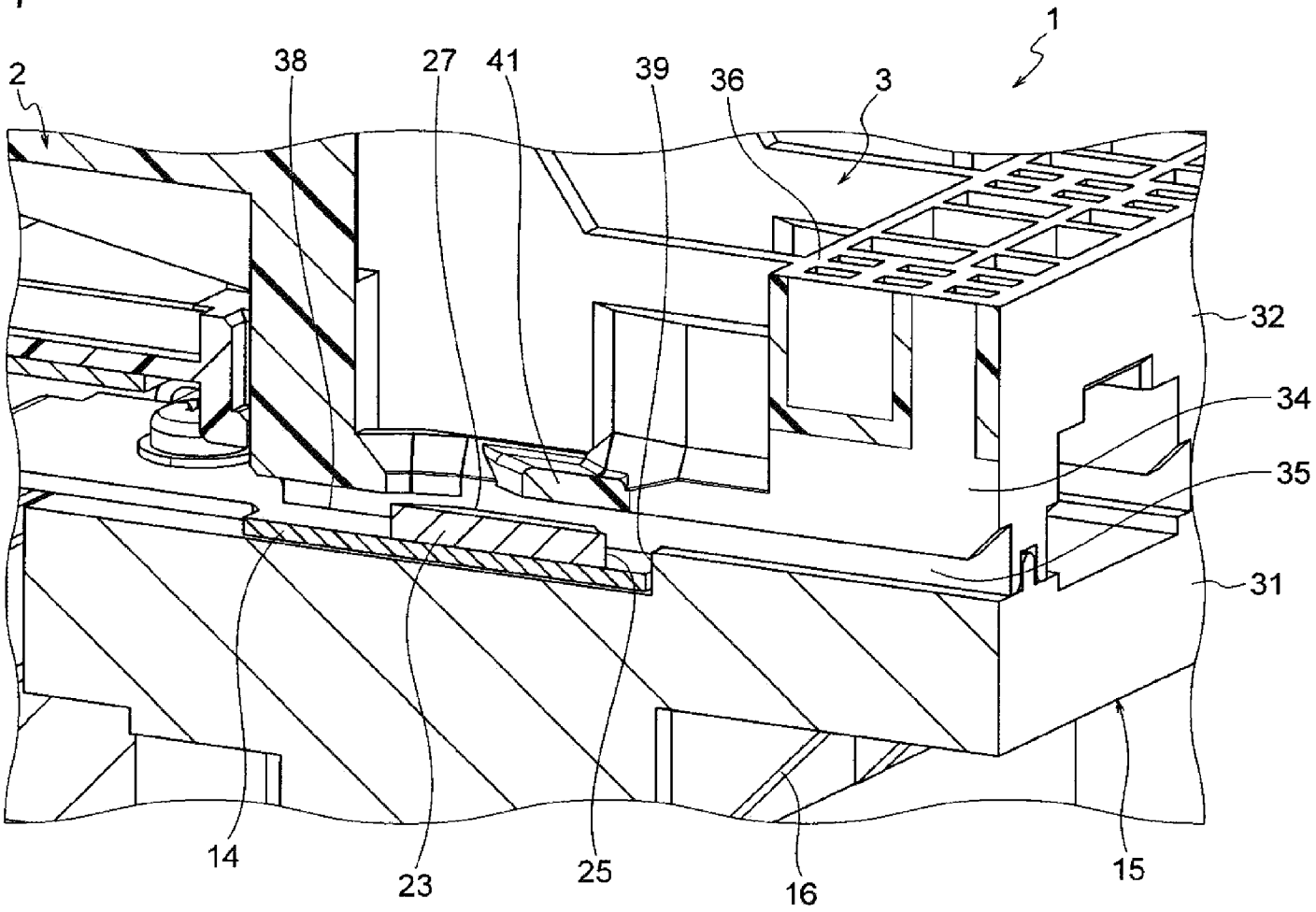
FIG. 11 is a perspective view (including a sectional view) corresponding to FIG. 8 as viewed from a different direction.
Figure 12:
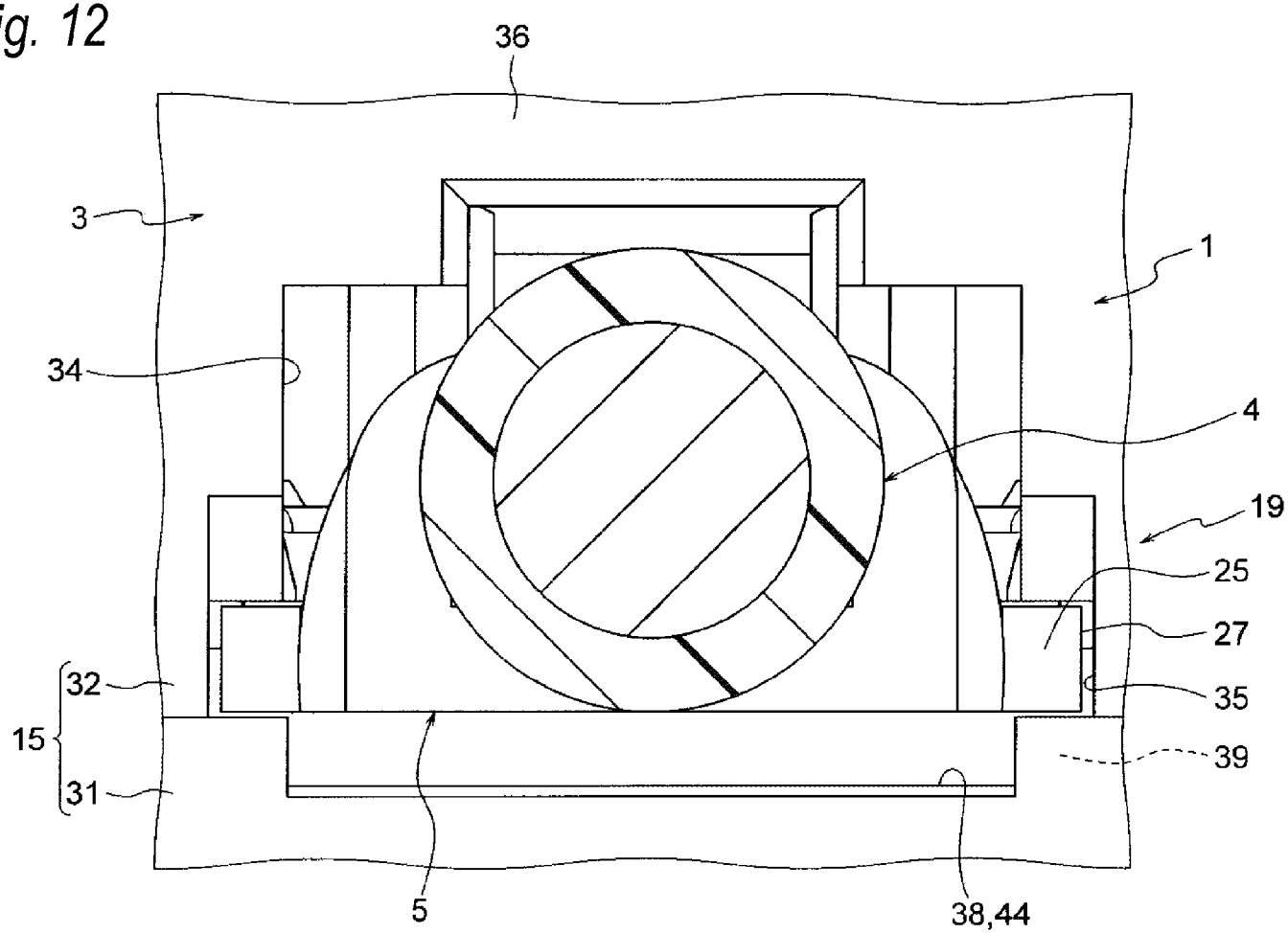
FIG. 12 is a view illustrating a state in which the terminal fitting for a cable terminal is in the middle of insertion into the housing.
Figure 13:
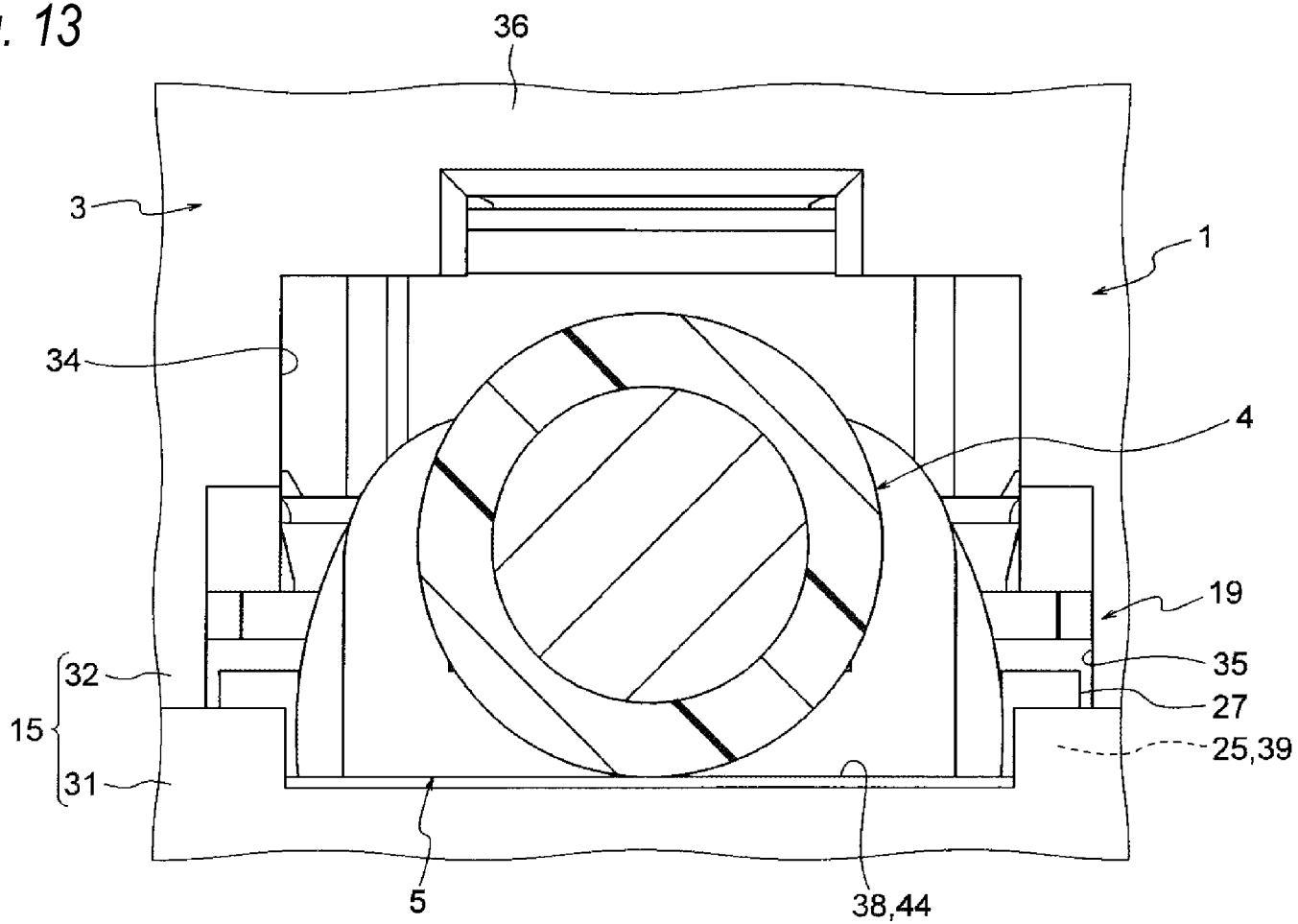
FIG. 13 is a view illustrating a state in which the terminal fitting of the cable terminal from FIG. 12 is dropped into a drop-in recess of the housing.

Hereinafter, an embodiment will be described with reference to the drawings. FIG. 1 is a perspective view of a device including a terminal temporary holding structure that is an embodiment of the present invention. FIG. 2 is a plan view of the terminal temporary holding structure. FIG. 3 is a plan view of the terminal temporary holding structure before a terminal fitting is inserted. FIG. 4 is a perspective view corresponding to FIG. 3. FIG. 5 is a perspective view corresponding to FIG. 4 as viewed from a different direction. FIG. 6 is a perspective view of a temporary holding unit on the side of a housing. FIG. 7 is a sectional view taken along line A-A of FIG. 2. FIG. 8 is a sectional view taken along line B-B of FIG. 2. FIGS. 9A and 9B are enlarged views of main parts. FIG. 10 is a perspective view corresponding to FIG. 7 as viewed from a different direction. FIG. 11 is a perspective view corresponding to FIG. 8 as viewed from a different direction. FIG. 12 is a view illustrating a state in which a terminal fitting for a cable terminal is in the middle of insertion into a housing. FIG. 13 is a view illustrating a state in which the terminal fitting of the cable terminal from FIG. 12 is dropped into a drop-in recess of the housing.

In FIG. 1, a terminal temporary holding structure 1 is adopted for an electrical connecting portion between a busbar block 3 for a device 2 mounted in, for instance, a movable object such as a vehicle and each terminal fitting 5 provided for a terminal of each cable 4.

In the device 2, a reference numeral 6 indicates a device main body. The device main body 6 is integrated by placing an electrical connection box 8 having the same size as an exothermal DC-DC converter 7 on the DC-DC converter 7. The DC-DC converter 7 includes a converter main body 9 and a heatsink part 10 that is arranged under the converter main body 9 and is formed of a metal. Meanwhile, the electrical connection box 8 includes an electrical connection box main body 11, a resin case 12 that constitutes the electrical connection box main body 11, and a resin cover 13 that covers a top surface opening of the resin case 12. The DC-DC converter 7 is an example, and may be a well-known control unit or the like.

The busbar block 3 for which the terminal temporary holding structure 1 is adopted is arranged at one side of the device main body 6. The busbar block 3 includes busbar terminals 14 (14*a* to 14*e*, see FIG. 3) that extend from the converter main body 9 and the electrical connection box main body 11 and are used for conductive busbars, an insulating housing 15 that holds these busbar terminals 14, and a metal case 16 that is formed in the heatsink part 10 in order to support the housing 15. The terminal temporary holding structure 1 is also adopted for the terminal fitting 5 in addition to the busbar block 3. Hereinafter, a configuration and structure of the terminal temporary holding structure 1 will be described.

In FIGS. 1 to 5, the terminal temporary holding structure 1 includes the terminal fitting 5 that is provided for the cable 4 and the terminal of the cable 4, the busbar block 3, a nut 17 (see FIG. 7, a fastening member) that is mounted close to the busbar block 3, a bolt 18 (a fastening member) that is screwed into the nut 17, and a temporary holding unit 19 that is formed of a plurality of portions.

In FIG. 3, the cable 4 includes a conductor 20 that is made by stranding a plurality of conductive strands and has a circular cross section, and an insulative insulator 21 that is formed outside the conductor 20 by extrusion. The cable 4 is a so-called thick cable in the present embodiment, and a cable having toughness is adopted. The cable 4 may be a thin cable. The cable 4 is produced in a state in which the insulator 21 is removed and the conductor 20 is exposed such that a terminal thereof has a predetermined length.

In FIG. 3, the terminal fitting 5 is formed by pressing a metal plate having conductivity. The terminal fitting 5 is inserted into the housing 15 of the busbar block 3, and is connected to the busbar terminal 14 (14*a*). The terminal fitting 5 includes a cable connecting part 22 to be connected to the cable 4, an electrical contact part 23 which is wider than the cable connecting part 22, abuts to the busbar terminal 14 (14*a*), and has a flat plate shape, a connecting part 24 that connects the electrical contact part 23 and the cable connecting part 22, a pair of terminal step parts 25, and a guided part 26, and is formed in an illustrated shape.

The cable connecting part 22 is attached to the terminal of the cable 4 by crimping. The electrical contact part 23 includes a pair of lateral parts 27 in a width direction and an arcuate tip part 28, and is formed in a U shape in a plan view. A circular bolt inserting hole 29 is formed to pass through the center of the electrical contact part 23. The connecting part 24 is formed in such a shape that necking occurs from a difference in width between the electrical contact part 23 and the cable connecting part 22.

In FIGS. 3 to 5, the pair of terminal step parts 25 are formed as stepped portions that are disposed at a connecting position at which the connecting part 24 and the electrical contact part 23 are connected. In other words, the pair of terminal step parts 25 are formed as corner portions that are disposed at the connecting position. The pair of terminal step parts 25 are formed as portions that are engaged with a pair of engagement step parts 39 a drop-in recess 38 to be described below. The pair of terminal step parts 25 are included in the temporary holding unit 19, and are portions that contribute to preventing the terminal fitting 5 from coming off. As for the pair of terminal step parts 25, any portions can be applied as long as the portions are engaged with the pair of engagement step parts 39 (portions at which abutting or catching occurs), and the pair of terminal step parts 25 are not limited to the illustrated shape.

In FIGS. 3, 4, and 9A and 9B, and 10, the guided part 26 is a portion that is disposed at a tip of the terminal fitting 5, and is formed in the tip part 28 of the electrical contact part 23 by bending. The guided part 26 is bent toward a surface of the electrical contact part 23. The guided part 26 is formed into a rectangular convex portion. When a tip of the guided part 26 slidably comes into contact with a guiding part 40 (see FIG. 9A) to be described below, the guided part 26 is formed in a portion at which the terminal fitting 5 is guided in a predetermined direction. Specifically, the guided part 26 is formed at a portion at which the terminal fitting 5 is guided downward along a fastening axis 43 to be described below. The guided part 26 is included in the temporary holding unit 19, and is a portion that contributes when the terminal fitting 5 is dropped into the drop-in recess 38 to be described below. Dropping into the drop-in recess 38 is possible even without the guided part 26 and the guiding part 40. However, it goes without saying that, with the guided part 26 and the guiding part 40, smooth dropping occurs.

In FIGS. 2 to 8, as described above, the busbar block 3 includes the busbar terminals 14 (14*a* to 14*e*), the housing 15, and the metal case 16.

Each busbar terminal 14 has conductivity, and is formed in a rectangular flat plate shape. A circular bolt inserting hole 30 is formed to pass through the center of the busbar terminals 14. The nut 17 is fixed to the housing 15 according to a position of the bolt inserting hole 30 (see FIGS. 7 and 10).

In FIGS. 3 to 8, the housing 15 of the present embodiment is formed of two components. That is, the housing 15 is formed of a lower housing 31 and an upper housing 32. The lower housing 31 and the upper housing 32 are resin moldings, and are superimposed and fixed by screws 33. The housing 15 having this configuration includes a terminal inserting port 34, a pair of terminal guides 35, a suppressing part 36, a fastening opening 37, the drop-in recess 38, a pair of engagement step parts 39, a guiding part 40, and a pair of engaging tongues 41, and is formed in an illustrated shape.

In FIGS. 4, 6 and 12, the terminal inserting port 34 is formed to be open as a portion at which the insertion of the terminal fitting 5 is started. The terminal inserting port 34 is formed in a shape in which there is relief such that the guided part 26 of the terminal fitting 5 is not caught in the event of insertion. The terminal inserting port 34 and the pair of terminal guides 35 to be described next are formed to be open at a position at which the lower housing 31 and the upper housing 32 are superimposed.

In FIGS. 4, 6 and 12, the pair of terminal guides 35 are formed as portions for guiding the pair of lateral parts 27 of the electrical contact part 23 when the insertion of the terminal fitting 5 is started. The cable connecting part 22 of the terminal fitting 5 is not guided due to the difference in width.

In FIGS. 2 to 5, 8, and 10, the suppressing part 36 is formed as a bridge-like portion that cuts across the cable connecting part 22 and/or the cable 4 after the insertion of the terminal fitting 5 is started and the electrical contact part 23 passes through the suppressing part 36. The suppressing part 36 is included in the temporary holding unit 19, and is a portion that contributes to preventing the terminal fitting 5 from coming off. To be more specific, the suppressing part 36 is a portion for suppressing the cable connecting part 22 and/or the cable 4 such that the cable connecting part 22 and/or the cable 4 do not exceed an allowable range before the bolt 18 is inserted and fastened, and do not float, and serves to be able to contribute to preventing the terminal fitting 5 from coming off by suppressing the floating. A plurality of holes are formed at the suppressing part 36, and these holes are not only holes that are generated by wall thickness reduction for molding, but also holes for relieving an influence of heat from the device main body 6 side by increasing a surface area.

In FIGS. 4 and 5, the fastening opening 37 is formed to be open in a size required to insert and fasten the bolt 18. A wall 42 by which the fastening opening 37 is divided is formed in a shape in which strength of the housing 15 can be secured, and in a fin shape for increasing a surface area to relieve an influence of heat from the device main body 6 side.

In FIGS. 3 to 6 and 10 to 13, the drop-in recess 38 is formed in a recessed portion into which the terminal fitting 5 which has been inserted into the housing 15 via the terminal inserting port 34 and has been guided by the pair of terminal guides 35 can be dropped along the fastening axis 43 of the bolt 18 by one step. The drop-in recess 38 is formed in a portion that is recessed using a surface for forming the pair of terminal guides 35 as a reference surface. The drop-in recess 38 is formed such that a shape (a contour) thereof in a plan view is fitted to that of the terminal fitting 5 in a plan view.

A reference numeral 44 in the drop-in recess 38 indicates a bottom surface. In addition, a reference numeral 45 indicates a busbar mounting part. The bottom surface 44 is formed as a surface that receives the terminal fitting 5 dropped by one step. The busbar mounting part 45 is formed as a portion that is mounted to expose the busbar terminal 14 from the bottom surface 44.

The bottom surface 44 is not merely a flat surface, but a surface from which the busbar terminal 14 is exposed. The drop-in recess 38 is formed in a shape recessed in two steps because the busbar terminal 14 is exposed from the bottom surface 44. That is, a recess of a first step is formed for the bottom surface 44, and a recess of a second step is formed in a portion for mounting the busbar terminal 14. When the busbar terminal 14 is mounted, the drop-in recess 38 appears to be a portion in a recessed state by one step.

Since the drop-in recess 38 is the recessed portion according to the shape (the contour) of the terminal fitting 5 in the plan view as described above, a step generated in a periphery of the drop-in recess 38 by forming this shape naturally becomes a portion that can restrict movement of the terminal fitting 5 after dropping in terminal inserting direction and a terminal width direction of the terminal fitting 5. The drop-in recess 38 is included in the temporary holding unit 19, and is a portion that contributes to preventing the terminal fitting 5 from coming off. For restricting movement in a direction in which the terminal comes off, the pair of engagement step parts 39 to be described next functions to restrict the movement.

In FIGS. 6, 8, 9A, 9B and 11 to 13, the pair of engagement step parts 39 are one of the steps generated due to the formation of the drop-in recess 38, and are formed as portions with which the pair of terminal step parts 25 of the terminal fitting 5 can be engaged (stepped portions for engagement). The pair of engagement step parts 39 correspond to one of the steps which is located at end positions of the pair of terminal guides 35. The pair of engagement step parts 39 are a step for restricting the movement in the direction in which the terminal comes off. The pair of engagement step parts 39 are disposed at positions at which the pair of terminal step parts 25 are opposite thereto when the terminal fitting 5 guided by the pair of lateral parts 27 is dropped into the drop-in recess 38. The pair of engagement step parts 39 are included in the temporary holding unit 19, and are portions that contributes to preventing the terminal fitting 5 from coming off.

In FIGS. 4, 7, 9 and 10, the guiding part 40 is included in the temporary holding unit 19, and is formed as a guide portion that contributes when the terminal fitting 5 is dropped into the drop-in recess 38. A taper 46 (see FIGS. 9A and 9B) to which the tip of the guided part 26 slidably comes into contact is formed in the guiding part 40. The guiding part 40 is formed in a portion for converting a direction of a force in the terminal inserting direction.

In FIGS. 2 to 7, the pair of engaging tongues 41 are formed in tongue-like portions that are located above the pair of terminal step parts 25 of the terminal fitting 5 that has been dropped into the drop-in recess 38. The pair of engaging tongues 41 are formed as portions that restrict the floating of the terminal fitting 5 before the bolt 18 is inserted and fastened.

As can be seen from the above description, the temporary holding unit 19 is formed of a plurality of portions. The temporary holding unit 19 is provided to temporarily hold the terminal fitting 5 before the bolt 18 is inserted and fastened. In the present embodiment, the pair of terminal step parts 25 and the guided part 26 of the terminal fitting 5 correspond to the temporary holding unit 19. The suppressing part 36, the drop-in recess 38, the pair of engagement step parts 39, the guiding part 40, and the pair of engaging tongues 41 of the housing 15 also correspond to the temporary holding unit 19. Particularly, the terminal step parts 25, the suppressing part 36, the drop-in recess 38, and the engagement step parts 39 are effective as the temporary holding unit 19.

According to the terminal temporary holding structure 1 that is one embodiment of the present invention including the temporary holding unit 19, even when the terminal fitting 5 dropped into the drop-in recess 38 of the housing 15 is likely to come off due to any factor, since the pair of terminal step parts 25 of the terminal fitting 5 are engaged with the pair of engagement step parts 39 of the drop-in recess 38, the terminal fitting 5 of the terminal of the cable 4 before the bolt 18 is inserted and fastened can be finally prevented from coming off from the housing 15. Since the suppressing part 36 having the shape that cuts across the cable connecting part 22 and/or the cable 4 of the terminal fitting 5 is provided as well, even when the terminal fitting 5 is about to move up from the drop-in recess 38 by one step, it is difficult for the terminal fitting 5 to move up. As a result, the terminal fitting 5 of the terminal of the cable 4 before the bolt 18 is inserted and fastened can be prevented from coming off from the housing 15.

According to the terminal temporary holding structure 1, the busbar terminal 14 and the terminal fitting 5 can be brought into contact with each other only by dropping the terminal fitting 5 into the drop-in recess 38 of the housing 15. Due to this contact, electrical connection can be completed only by inserting and fastening the bolt 18 later. According to the terminal temporary holding structure 1, it is possible to contribute to the improvement of workability.

According to the terminal temporary holding structure 1, even when the terminal fitting 5 dropped into the drop-in recess 38 of the housing 15 is moved in the terminal inserting direction or in the terminal width direction due to any factor, the movement can be restricted with the shape of the drop-in recess 38. According to the terminal temporary holding structure 1, it is possible to contribute to positioning of the terminal fitting.

According to the terminal temporary holding structure 1, when the terminal fitting 5 of the terminal of the cable 4 is inserted into the housing 15, the guided part 26 of the terminal fitting 5 is guided by the guiding part 40 of the housing 15. As a result, the terminal fitting 5 can be smoothly dropped into the drop-in recess 38 of the housing 15. According to the terminal temporary holding structure 1, it is possible to contribute to the improvement of workability.

As described with reference to FIGS. 1 to 13, according to the terminal temporary holding structure 1 that is one embodiment of the present invention, an effect that the terminal fitting 5 of the terminal of the cable 4 before the bolt 18 is inserted and fastened can be prevented from coming off from the housing 15 is exerted.

Of course, the present invention can be variously modified without departing from the spirit of the present invention.

Here, the features of the embodiment of the electronic unit according to the invention described above are summarized briefly in (1) to (4) described below.

(1) A terminal temporary holding structure 1 including:

a busbar block 3 including an insulating housing 15 and a conductive busbar terminal 14;

a conductive terminal fitting 5 inserted into the housing 15 and electrically connected to the busbar terminal 14; and a cable 4 in which a terminal thereof is connected with the terminal fitting 5, wherein the terminal fitting 5 includes:

a cable connecting part 22 connected to the cable 4;

an electrical contact part 23 configured to be fastened to the busbar terminal 14 by a fastening member 17, 18 and having a flat plate shape which is wider than the cable connecting part 22; and a connecting part 24 that connects the electrical contact part 23 and the cable connecting part 22, a terminal step part 25 is formed in the terminal fitting 5 at a position at which the connecting part 24 and the electrical contact part 23 are connected to each other, the housing 15 includes a suppressing part 36 and a drop-in recess 38, the drop-in recess 38 accommodates the electrical contact part 23 so that the electrical contact part 23 is dropped along a fastening axis 43 of the fastening member 17, 18, the suppressing part 36 is provided so as to be disposed over at least one of the cable connecting part 22 and the cable 4 in a state that the drop-in recess 38 accommodates the electrical contact part 23, and an engagement step part 39 configured to engage to the terminal step part 25 is formed in a step of a periphery of the drop-in recess 38 so as to temporarily hold the terminal fitting 5 in cooperation with the suppressing part 36 before the electrical contact part 23 is fastened to the busbar terminal 14 by the fastening member 17, 18.

(2) The terminal temporary holding structure 1 according to (1), wherein the drop-in recess 38 includes a bottom surface 44 receiving the electrical contact part 23 and a busbar mounting part 45 exposing the busbar terminal 14 from the bottom surface 44 in the state that the drop-in recess 38 accommodates the electrical contact part 23.

(3) The terminal temporary holding structure 1 according to (1) or (2), wherein the step of the drop-in recess 38 restrict movements of the terminal fitting 5 in a terminal inserting direction and a terminal width direction in the state that the drop-in recess 38 accommodates the electrical contact part 23.

(4) The terminal temporary holding structure 1 according to any one of (1) to (3), wherein a guided part 26 is provided in the terminal fitting 5, and a guiding part 40 is provided in the housing 15 so as to come in contact with the guided part 26 to guide the terminal fitting 5 into the drop-in recess 38.

According to the configuration of the invention, even when the terminal fitting dropped into the drop-in recess of the housing is likely to come off due to any factor, since the terminal step parts of the terminal fitting are engaged with the engagement step parts of the drop-in recess, the terminal fitting of the cable terminal before fastening can be prevented from coming off from the housing. Since the suppressing part having the shape that cuts across the cable connecting part and/or the cable is provided as well, even when the terminal fitting is about to move up from the drop-in recess by one step, it is difficult for the terminal fitting to move up. As a result, the terminal fitting of the cable terminal before fastening can be prevented from coming off from the housing.

According to the configuration of the invention, the busbar terminal and the terminal fitting can be brought into contact with each other only by dropping the terminal fitting into the drop-in recess of the housing. Due to this contact, electrical connection can be completed only by fastening the fastening member later. According to the invention, it is possible to contribute to the improvement of workability.

According to the configuration of the invention, even when the terminal fitting dropped into the drop-in recess of the housing is moved in the terminal inserting direction or in the terminal width direction due to any factor, the movement can be restricted with the shape of the drop-in recess. According to the present invention, it is possible to contribute to positioning of the terminal fitting.

According to the configuration of the invention, when the terminal fitting of the cable terminal is inserted into the housing, the guided part of the terminal fitting is guided by the guiding part of the housing. As a result, the terminal fitting can be smoothly dropped into the drop-in recess of the housing. According to the invention, it is possible to contribute to the improvement of workability.

According to the terminal temporary holding structure of the invention, an effect can be obtained that the terminal fitting of the cable terminal before fastening can be prevented from coming off from the housing.

What is claimed is:

1. A terminal temporary holding structure comprising:

a busbar block including an insulating housing and a conductive busbar terminal;

a conductive terminal fitting inserted into the housing and electrically connected to the busbar terminal; and a cable in which a terminal thereof is connected with the terminal fitting, wherein the terminal fitting includes:

a cable connecting part connected to the cable;

an electrical contact part configured to be fastened to the busbar terminal by a fastening member and having a flat plate shape which is wider than the cable connecting part; and a connecting part that connects the electrical contact part and the cable connecting part, a terminal step part is formed in the terminal fitting at a position at which the connecting part and the electrical contact part are connected to each other, the housing includes a suppressing part and a drop-in recess, the drop-in recess accommodates the electrical contact part so that the electrical contact part is dropped along a fastening axis of the fastening member, the suppressing part is provided so as to be disposed over at least one of the cable connecting part and the cable in a state that the drop-in recess accommodates the electrical contact part, and an engagement step part configured to engage to the terminal step part is formed in a step of a periphery of the drop-in recess so as to temporarily hold the terminal fitting in cooperation with the suppressing part before the electrical contact part is fastened to the busbar terminal by the fastening member.

2. The terminal temporary holding structure according to claim 1, wherein the drop-in recess includes a bottom surface receiving the electrical contact part and a busbar mounting part exposing the busbar terminal from the bottom surface in the state that the drop-in recess accommodates the electrical contact part.

3. The terminal temporary holding structure according to claim 1, wherein the step of the drop-in recess restrict movements of the terminal fitting in a terminal inserting direction and a terminal width direction in the state that the drop-in recess accommodates the electrical contact part.

4. The terminal temporary holding structure according to claim 1, wherein a guided part is provided in the terminal fitting, and a guiding part is provided in the housing so as to come in contact with the guided part to guide the terminal fitting into the drop-in recess.

* * * * *